US008785797B2

(12) United States Patent
Cortinovis et al.

(10) Patent No.: US 8,785,797 B2
(45) Date of Patent: Jul. 22, 2014

(54) MEDIUM VOLTAGE CIRCUIT BREAKER

(75) Inventors: Gianluca Cortinovis, Albino (IT); Giorgio Moriconi, Torre Boldone (IT)

(73) Assignee: ABB Technology AG, Zurich (CH)

( * ) Notice: Subject to any disclaimer, the term of this patent is extended or adjusted under 35 U.S.C. 154(b) by 276 days.

(21) Appl. No.: 12/973,383

(22) Filed: Dec. 20, 2010

(65) Prior Publication Data

US 2011/0155555 A1 Jun. 30, 2011

(30) Foreign Application Priority Data

Dec. 29, 2009 (EP) ..... 09180909

(51) Int. Cl.
*H01H 13/20* (2006.01)

(52) U.S. Cl.
USPC ..... 200/501; 200/337

(58) Field of Classification Search
USPC ..... 200/17 R, 400, 401, 500, 501, 329, 334, 200/337, 338; 218/1, 7, 14, 78, 92, 120, 218/140, 153, 154
See application file for complete search history.

(56) References Cited

U.S. PATENT DOCUMENTS

| | | | | |
|---|---|---|---|---|
| 4,167,659 | A * | 9/1979 | Yamanaka et al. | 200/401 |
| 4,227,059 | A * | 10/1980 | Ogawa | 200/248 |
| 6,531,841 | B1 * | 3/2003 | Elli et al. | 318/466 |
| 6,678,151 | B2 * | 1/2004 | Costante | 361/602 |
| 6,713,984 | B1 * | 3/2004 | Valdemarsson | 318/640 |
| 6,750,567 | B1 * | 6/2004 | Elli et al. | 307/143 |
| 7,199,324 | B2 * | 4/2007 | Perret | 218/3 |
| 7,426,100 | B2 * | 9/2008 | Neveu et al. | 361/115 |
| 7,563,161 | B2 * | 7/2009 | Perret | 463/13 |
| 8,081,407 | B2 * | 12/2011 | Willieme et al. | 361/20 |
| 2005/0247677 | A1 | 11/2005 | Perret | |

FOREIGN PATENT DOCUMENTS

| | | | |
|---|---|---|---|
| CN | 1527338 | A | 9/2004 |
| CN | 1722332 | A | 1/2006 |
| EP | 0141598 | A1 | 5/1985 |
| EP | 1310970 | A1 | 5/2003 |
| EP | 1580783 | A1 | 9/2005 |
| FR | 2896336 | A1 | 7/2007 |

OTHER PUBLICATIONS

Extended European Search Report issued in corresponding European Application No. 09180909.5 dated Jun. 9, 2010.
Chinese Office Action dated Mar. 12, 2014.

* cited by examiner

*Primary Examiner* — Felix O Figueroa
(74) *Attorney, Agent, or Firm* — Novak Druce Connolly Bove + Quigg LLP

(57) ABSTRACT

A Medium Voltage circuit breaker which comprises a pole assembly having, for each phase, a first fixed contact and a second movable contact reciprocally couplable/uncouplable between an open and close position. The circuit breaker further comprises an actuator to actuate the opening and closing operation of said circuit breaker, and a kinematic chain operatively connecting said actuator to said movable contact. The kinematic chain comprises a sliding element operatively connected to said actuator, said sliding element having a first sliding surface operatively coupled to said movable contact and being movable between a first, open, position and a second, closed, position.

13 Claims, 3 Drawing Sheets

MEDIUM VOLTAGE CIRCUIT BREAKER

CROSS REFERENCE TO RELATED APPLICATIONS

This application claims priority to Application No. 09180909.5 filed in Europe on Dec. 29, 2009 under 35 U.S.C. §119, the entire contents of which are hereby incorporated by reference.

The present invention relates to a medium voltage circuit breaker with improved features, and in particular to a medium voltage circuit breaker having a new kinematic chain for actuating the opening and closing operations of said circuit breaker. For the purposes of the present application the term medium voltage is referred to applications in the range of between 1 and 52 kV.

Medium voltage circuit breaker are well known in the art. They usually consist of a pole assembly having, for each phase, a fixed contact and a movable contact. This latter is typically movable between a first position, in which it is coupled to the fixed contact, and a second position, in which it is uncoupled from said fixed contact, thereby realizing the opening and closing operation of the circuit breaker.

The energy required for the movement of the movable contacts is typically provided by a drive mechanism having an actuator which is operatively connected to the movable contacts through a kinematic chain.

Currently, the movement of the movable contact is therefore actuated through a complex kinematic chain with levers, pins, screws, rings, and similar, which links the movable contacts to the actuator. This solution, even if it allows to obtain a satisfactory transmission of motion between the actuator and the movable contact assembly, has a number of disadvantages.

The transmission of the movement to the movable contact through a kinematic chain, permanently linking the movable contacts to the actuator, involves the construction and assembly of a large number of parts. The kinematic chain itself is very complex, involving a large number of parts and normally combining rotational and translational movements, with the possibility of failures of the movement.

As a consequence, the production process is long and complicated and the required times for assembly and adjusting the various parts of the kinematic chain are generally high, due also to little spaces available on the frame of the circuit breaker.

In addition, depending on the intended applications and rating of the circuit breaker, the travel curve of the movable contact can be different. As a consequence, different actuators and/or kinematic chains are therefore necessary in order to meet the different requirements in terms of travel curve of the movable contact.

It is therefore an object of the present invention to provide a medium voltage circuit breaker in which the above-mentioned drawbacks are avoided or at least reduced.

More in particular, it is an object of the present invention to provide a medium voltage circuit breaker having a driving system, and in particular the kinematic chain for actuating the opening/closing operation, of reduced complexity.

As a further object, the present invention is aimed at providing a medium voltage circuit breaker in which the kinematic chain linking the movable contacts to the actuator has a reduced number of mechanical parts.

A further object of the present invention is to provide a medium voltage circuit breaker with reduction of time to assembly.

Still a further object of the present invention is to provide a medium voltage circuit breaker in which the kinematic chain can be pre-assembled outside the main production line of the circuit breaker.

Another object of the present invention is to provide a medium voltage circuit breaker in which it is relatively easy to change the travel curve of the movable contacts.

Still another object of the present invention is to provide a medium voltage circuit breaker with reduced manufacturing, installation and maintenance costs.

Thus, the present invention relates to a Medium Voltage circuit breaker which characterized in that it comprises a pole assembly having, for each phase, a first fixed contact and a second movable contact reciprocally couplable/uncouplable between an open and close position. The Medium Voltage circuit breaker of the invention further comprises an actuator to actuate the opening and closing operation of said circuit breaker and a kinematic chain operatively connecting said actuator to said movable contact. In the circuit breaker according to the invention, said kinematic chain comprises a sliding element operatively connected to said actuator, said sliding element having a first sliding surface operatively coupled to said movable contact and being movable between a first, open, position and a second, closed, position.

In this way, it is possible to overcome some of the disadvantages and drawbacks of the circuit breaker of the known art. As better explained hereinafter, the kinematic chain linking the movable contact to the actuator is extremely simple.

The movement of movable contact is obtained without any permanent mechanical connection between the movable contact assembly and the kinematic chain. As better shown in the following detailed description, in the circuit breaker of the invention the movement is obtained with sliding coupling of the movable contact assembly with the sliding surface of the sliding element in the kinematic chain.

The number of components is therefore greatly reduced, with consequent reduction of costs and time of manufacturing, installation and maintenance.

Also, the various components of the circuit breaker can be pre-assembled outside the main production line of the circuit breaker; then the pole assembly, the actuator and the kinematic chain can be easily assembled on the frame by fixing them to the frame without any mechanical connection between pole assembly and kinematic chain.

Preferably, in the Medium Voltage circuit breaker according to the invention, said sliding element is movable in a first direction and said second movable contact is movable in a second direction transverse to said first direction, said second direction being more preferably perpendicular to said first direction.

Advantageously, the sliding element of the kinematic chain is hinged on first lever operatively connected to said actuator.

Preferably, the sliding element comprises also a second sliding surface operatively coupled to a support element. For instance, said support element can comprise a first roller.

Advantageously, also the first sliding surface is operatively coupled to a second roller which is connected to said movable contact.

By suitably shaping the profile of said first sliding surface, it is also possible to provide a variable speed of said movable contact during said opening and closing operation of said circuit breaker.

In said case, the profile of said first sliding surface can have, for instance, at least a first and a second segment having different slopes.

Preferably, in the Medium Voltage circuit breaker according to the invention, said sliding element is made of insulating material.

According to a preferred embodiment, the Medium Voltage circuit breaker of the invention comprises a control device that checks the position of the contacts and drives a corresponding interlock device, said control device being operatively positioned on said sliding element.

Further characteristics and advantages of the invention will emerge from the description of preferred, but not exclusive embodiments of a Medium Voltage circuit breaker according to the invention, non-limiting examples of which are provided in the attached drawings, wherein.

Figure 1:
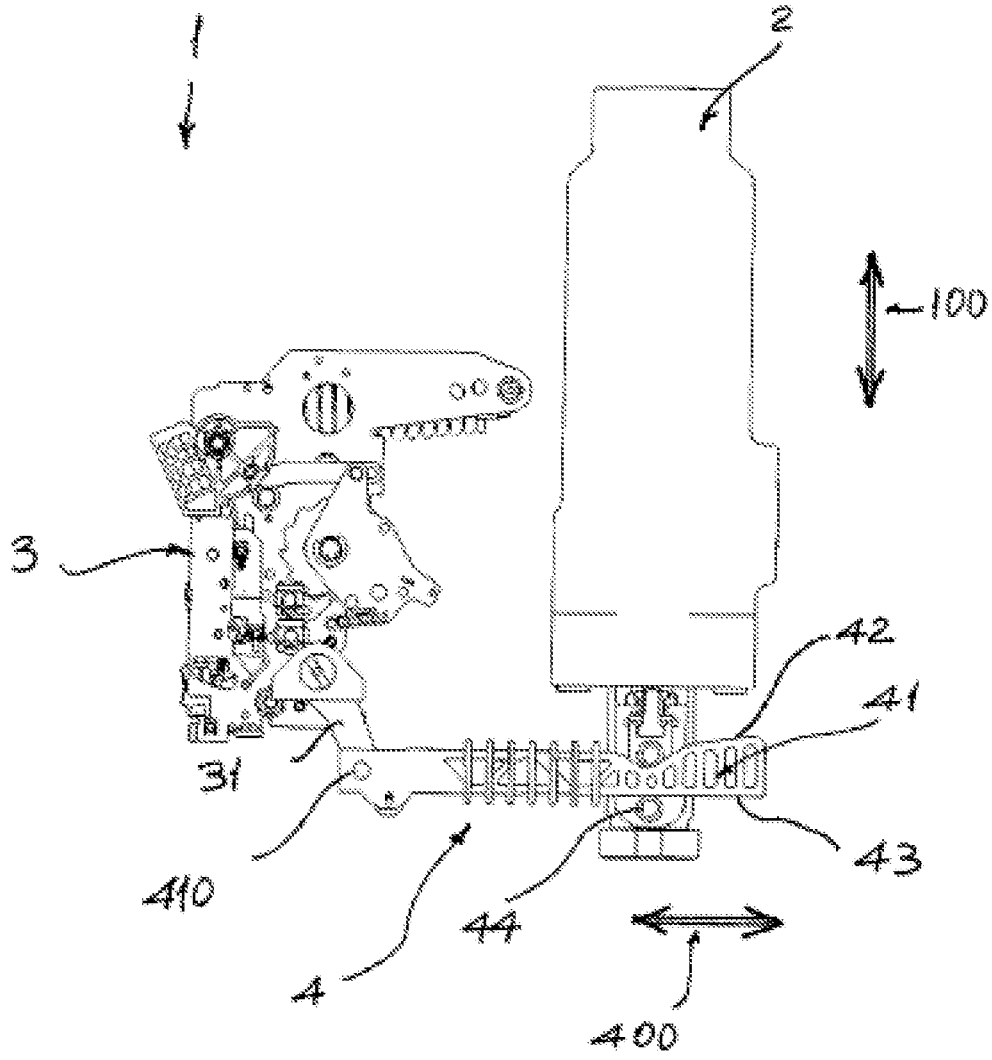
FIG. 1 is a schematic side view of a Medium Voltage circuit breaker in a first position (open position)

With reference to the attached figures, a Medium Voltage circuit breaker according to the invention, designed with the reference number 1, in its more general definition, comprises a pole assembly 2 having, for each phase, a first fixed contact and a second movable contact. (Fixed and movable contacts are not shown in the attached drawings). Normally the circuit breaker is a three-phase circuit breaker and thus comprises three sets of fixed/movable contacts reciprocally couplable/uncouplable between an open and close position. Fixed and movable contacts can be conventional contacts of known type and therefore will not be described in more details.

The circuit breaker according to the invention further comprises an actuator 3 to actuate the opening and closing operation of said circuit breaker and a kinematic chain 4 operatively connecting said actuator 3 to said movable contact. Also the actuator can be a conventional actuator of known type and therefore will not be described in more details being known per se.

One of the characterizing features of the circuit breaker of the invention is that said kinematic chain 4 comprises a sliding element 41 which is operatively connected to said actuator 3. In particular, said sliding element 41 has a first sliding surface 42 which is operatively coupled to said movable contact and which is movable between a first, open, position and a second, closed, position.

Figure 2:
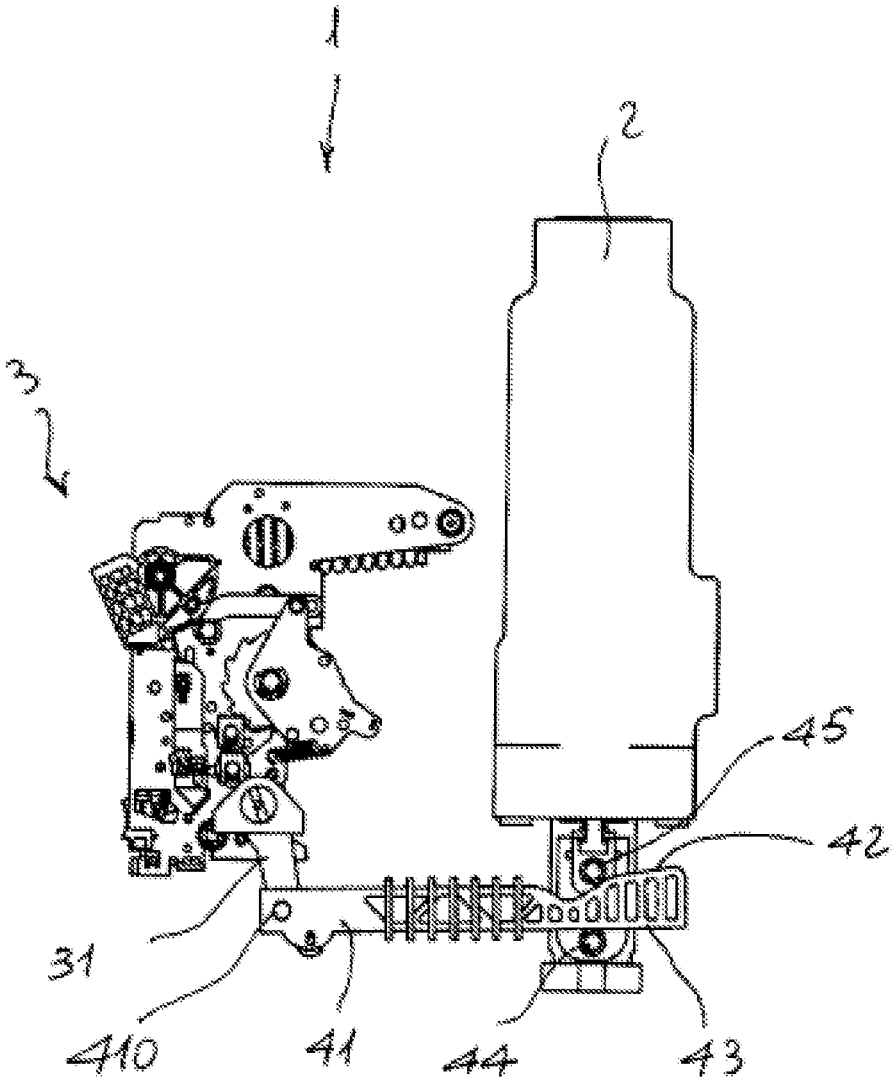
FIG. 2 is a schematic side view of the Medium Voltage circuit breaker of FIG. 1 in a second position (intermediate position)
Figure 3:
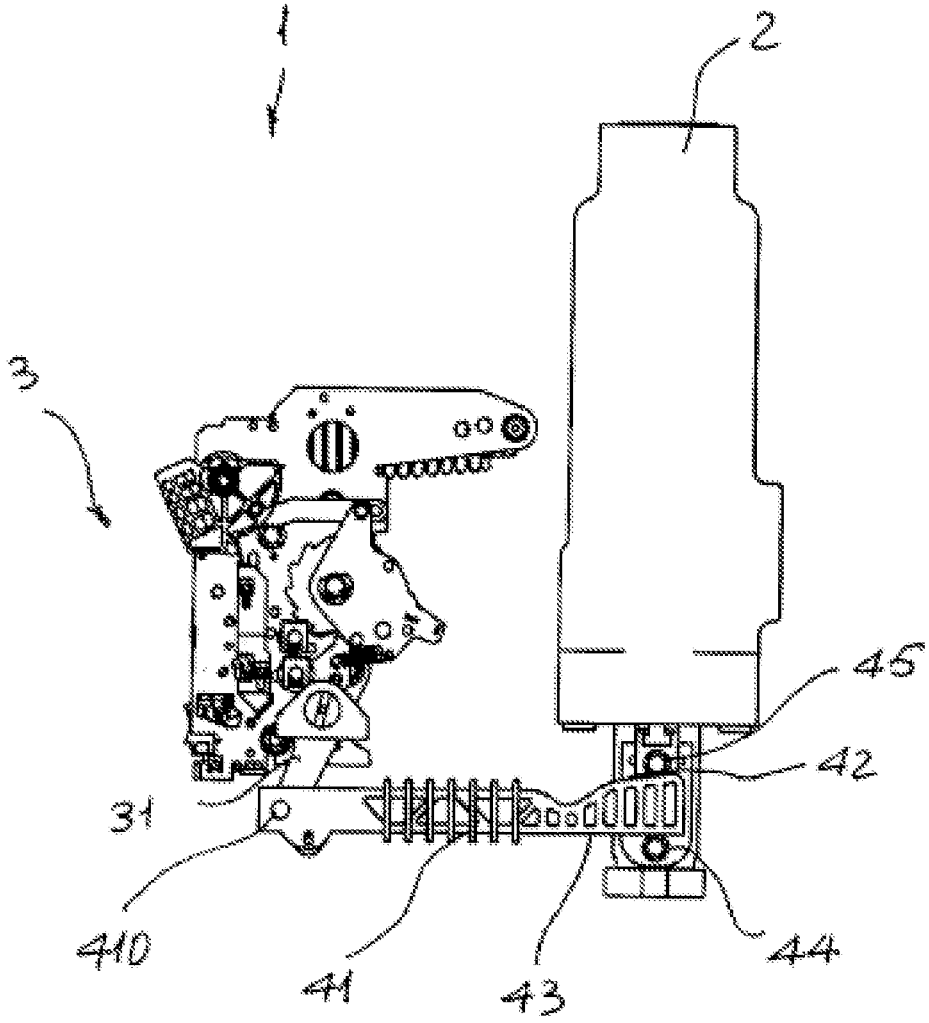
FIG. 3 is a schematic side view of the Medium Voltage circuit breaker of FIG. 1 in a third position (close position).

In practice, starting form the situation shown in FIG. 1 (corresponding to an open position of the contacts), when a closing operation is launched, the actuators 3 moves the first sliding element 41 of the kinematic chain 4 towards the left (see FIG. 2), until the closed position of FIG. 3 is reached.

During this movement, the sliding surface 42 of the sliding element 41 interacts with the movable contact assembly through a coupling element, e.g. a roller 45, which slides on said surface 42. Since the profile of the sliding surface 42 is not flat, during the leftward movement of the sliding element 41, motion is transmitted to the movable contact assembly which is moved upwardly until the closed position of FIG. 3 is reached.

The opening operation is carried out in the opposite way. Thus, starting form the situation shown in FIG. 3 (corresponding to a closed position of the contacts), when an opening operation is launched, the actuators 3 moves the first sliding element 41 of the kinematic chain 4 towards the right (see FIG. 2), until the open position of FIG. 1 is reached.

In this case, during the rightward movement of the sliding element 41, the movable contact assembly is allowed to move downwardly until the open position of FIG. 1 is reached.

It is therefore clear form the above that the present invention allows obtaining a motion of the movable in a very simple way and without any permanent mechanical linking of the movable contact assembly to the kinematic chain 4.

With reference to FIG. 1, preferably the shape and positioning of the sliding element 41 and of the pole assembly 2 is such that the sliding element 41 is movable in a first direction indicated by the double arrow 400, while the movable contact assembly is movable in a second direction indicated by the double arrow 100. As shown in FIG. 1, the direction of movement 400 of the sliding element 41 is transverse to the direction of movement 100 of the movable contact assembly. More preferably, as shown in the above-mentioned figure, the direction of movement 400 of the sliding element 41 is substantially perpendicular to the direction of movement 100 of the movable contact assembly. In this way, it is possible to achieve a more compact design and structure of the circuit breaker of the invention.

According to a preferred embodiment, the sliding element 41 of the kinematic chain 4 is hinged on a first lever 31 in correspondence of a pivot point 410 on said sliding element 41. Said first lever 31 is operatively connected to the actuator 3, so that, when an opening or closing operation is actuated, motion is transmitted from the actuator 3 to the sliding element 41 of the kinematic chain 4.

Advantageously, the sliding 41 element can comprise a second sliding surface 43 operatively coupled to a support element 44. The supporting element 44 is preferably mounted on a fixed part of the circuit breaker, so as to act as supporting and guiding element for the sliding element 41. According to a preferred embodiment of the invention, the support element 44 comprises a first roller onto which the second sliding surface 43 of the sliding element can slide with very little friction.

Conveniently, also the first sliding surface 42 can be operatively coupled to the movable contact assembly through a second roller 45 connected to said movable contact.

In this way energy dissipation due to frictions of the first sliding element 41, and in particular of the first 42 and second 43 sliding surfaces with the corresponding coupling elements (i.e. rollers 45 and 44), is considerably reduced.

According to a preferred embodiment of the circuit breaker of the invention, the profile of said first sliding surface 42 is shaped so as to provide a variable speed of said movable contact during said opening and closing operation of said circuit breaker 1.

In this way it is possible to tailor the speed of the movable contact according to the needs, e.g. greater speed at the initial stage of movement and reduced speed when the movable contact is close to the end of travel during closing operation.

In order to achieve this result, as shown in the attached figures, the profile of said first to sliding surface 42 can have at least a first and a second segment having different slopes. Thus, the upward and downward speed of the movable contact will be different, depending on the slope of the segments of the sliding surface 42.

It is worth noting that, a variable speed of the movable contact assembly can be achieve also by suitably shaping other elements of the kinematic chain, e.g. the first lever 31 and/or the coupling between the sliding element 41 and said first lever 31.

A further important feature of the kinematic chain 4 of the circuit breaker 1 of the present invention is given by the possibility to change the travel curve of the movable contacts simply by changing the profile of the sliding surface 42. In other words, it is possible to meet different circuit breaker requirements, in terms of travel curve of the movable contact, by changing the sliding element 41. It is therefore possible to achieve a high degree of standardization of the components needed for the manufacturing of circuit breakers with different rating or intended applications.

According to a particularly preferred embodiment of the medium voltage circuit breaker 1 according to the invention, said sliding element 41 is made of insulating material.

In a particular embodiment of the invention (not shown in the attached figures), the Medium Voltage circuit breaker of the invention comprises a control device that checks the position of the contacts (i.e. open or closed) and drives a corresponding interlock device, said control device being operatively positioned on said sliding element 41. In other words, according to this embodiment, a control device is positioned in correspondence of the sliding element 41, said control device being able to detect the position of movable contact and therefore determine the open or closed position of the circuit breaker. An interlock device is associated to said control device and it is driven by it in case of incorrect opening or closing operation.

It is clear from the above that medium voltage circuit breaker of the invention have a number of advantages with respect to similar partitioning device and cubicles of known type.

In particular, the medium voltage circuit breaker of the invention does not require the use of a complicated kinematic chain permanently linking the actuator to the movable contact assembly, the movement being obtained directly by sliding of the movable contact assembly on the first sliding surface 42 of the sliding element 41. This allows to reduce the number of components, thereby reducing the manufacturing, installation and maintenance costs.

Also since no mechanical connection is required between kinematic chain and pole assembly, manufacturing time and costs are considerably reduced.

Moreover, as explained above, it is very easy to meet the different requirements in terms of travel curve of the movable contact by suitably adapting the shape of the profile of the first sliding surface 42 of the sliding element 41.

In general, the structure of the kinematic chain of the medium voltage circuit breaker of the invention, with only a few components easy to manufacture and assemble, is greatly simplified with respect to the known medium voltage circuit breaker.

The medium voltage circuit breaker thus conceived may undergo numerous modifications and come in several variants, all coming within the scope of the inventive concept. Moreover, all the component parts described herein may be substituted by other, technically equivalent elements. In practice, the component materials and dimensions of the device may be of any nature, according to need and the state of the art.

The invention claimed is:

1. A medium voltage circuit breaker comprising a pole assembly having, for each phase, a first fixed contact and a second movable contact reciprocally couplable/uncouplable between an open and close position, an actuator to actuate an opening and closing operation of said circuit breaker, and a kinematic chain operatively connecting said actuator to said movable contact, said kinematic chain comprising a sliding element operatively connected to said actuator and which is linearly movable by said actuator, said sliding element having a first sliding surface operatively coupled to said movable contact and a second sliding surface, which is opposite to said first sliding surface;

wherein said sliding element moves without rotating around the connection point with said actuator;

wherein said first sliding surface is coupled to a second roller that is connected to said movable contact and said second sliding surface is operatively coupled to a first roller that is mounted on a fixed part of the circuit breaker;

wherein said first sliding element is movable between an open position and closed position;

wherein a profile of said first sliding surface is not flat and is shaped so that the profile of said first sliding surface has at least a first and a second segment having different slopes;

wherein the profile of said second sliding surface is flat and straight for the entire length of said second sliding surface;

wherein said second roller and said movable contact are linearly movable along a same second direction of movement that is perpendicular to the first direction of movement of said sliding element;

wherein said first roller is in a fixed position with respect to said sliding element to support said sliding element.

2. The medium voltage circuit breaker according to claim 1, wherein said sliding element is movable in a first direction and said second movable contact is movable in a second direction transverse to said first direction.

3. The medium voltage circuit breaker according to claim 1, wherein that said sliding element is hinged on a first lever operatively connected to said actuator.

4. The medium voltage circuit breaker according claim 1, wherein said sliding element comprises the second sliding surface operatively coupled to the first roller.

5. The medium voltage circuit breaker according to claim 1, wherein said first sliding surface is operatively coupled to the second roller connected to said movable contact.

6. The medium voltage circuit breaker according to claim 1, wherein the profile of said first sliding surface is shaped so as to provide a variable speed of said movable contact during said opening and closing operation of said circuit breaker.

7. The medium voltage circuit breaker according to claim 1, wherein said sliding element is made of insulating material.

8. The medium voltage circuit breaker according to claim 1, further comprising a control device that checks the position of the contacts and drives a corresponding interlock device, said control device being operatively positioned on said sliding element.

9. The medium voltage circuit breaker according to claim 2, wherein that said sliding element is hinged on a first lever operatively connected to said actuator.

10. The medium voltage circuit breaker according to claim 2, wherein said sliding element comprises a second sliding surface operatively coupled to the first roller.

11. The medium voltage circuit breaker according to claim 3, wherein said sliding element comprises the second sliding surface operatively coupled to the first roller.

12. The medium voltage circuit breaker according to claim 2, wherein said first sliding surface is operatively coupled to the second roller connected to said movable contact.

13. The medium voltage circuit breaker according to claim 3, wherein said first sliding surface is operatively coupled to the second roller connected to said movable contact.

* * * * *